United States Patent [19]

Sadao et al.

[11] Patent Number: 4,705,241

[45] Date of Patent: Nov. 10, 1987

[54] SWITCH MOUNTING DEVICE

[75] Inventors: Ando Sadao, Chigasaki; Saito Satoshi, Kamakura, both of Japan

[73] Assignee: Yamatake-Honeywell Co., Ltd., Tokyo, Japan

[21] Appl. No.: 939,329

[22] Filed: Dec. 8, 1986

[51] Int. Cl.[4] ..... G12B 9/00

[52] U.S. Cl. ..... 248/27.3; 200/295

[58] Field of Search ..... 200/294, 295, 296, 153 T; 248/27.3

[56] References Cited

U.S. PATENT DOCUMENTS 3,866,868 2/1975 Fish et al. ..... 200/296

*Primary Examiner*—M. H. Paschall
*Assistant Examiner*—Morris Ginsburg
*Attorney, Agent, or Firm*—Charles L. Rubow

[57] ABSTRACT

A switch mounting device with a base having a pair of spaced parallel rails and a receiving member at one end of the rails which extends from the base a distance at least as great as the height of the switch side walls. Each of the rails includes a projecting guide which extends from the base a distance at least as great as the height of the switch side walls. The receiving member and projecting guides each have a lug formed thereon for engaging the upper surface of the switch when it is in place. The base is formed with first and second resilient cantilevered members, the first of which has a free end extending away from a receiving member and terminating in a lug which engages the side wall of the switch opposite the receiving member when the switch is in place. The second cantilevered member has a free end proximate the receiving member which bears against the lower surface of the switch to urge the switch toward the lugs.

3 Claims, 7 Drawing Figures

SWITCH MOUNTING DEVICE

BACKGROUND OF THE INVENTION

The present invention generally relates to a switch mounting device, and more particularly to an improved switch mounting device which offers secure switch mounting, easy switch insertion and removal and good electrical protection for the switch terminals.

Miniature electrical switches are used in great numbers in a wide variety of consumer and industrial products. It is known to use switch mounting devices to facilitate the manufacture and repair of such products. Conventional switch mounting devices offer certain advantages over mounting switches directly to the products or equipment in which they are used by means of bolts or screws. However, further improvements are desired to maximize the ease and reliability with which switches can be mounted and/or replaced. The present invention achieves improvements in providing firm switch mounting and good protection of electrical terminals while facilitating removal and/or replacement.

SUMMARY OF THE INVENTION

The invention is a switch mounting device having a base with a pair of rails thereon defining a channel for receiving a switch. Each of the rails includes a portion which projects from the base a distance at least as great as the height of the side walls of the switch case, the projecting portions having lugs formed thereon adapted to engage a side of the case opposite the base. A receiving member is formed on the base at one end of the rails, the receiving member projecting from the base a distance at least as great as the height of the side walls of the switch case, and having a lug formed thereon adapted to engage the side of the case opposite the base. First and second resilient cantilevered members are formed in the base, the first member having a free end which extends away from the receiving member and is inclined away from the base, and which is formed with a projection thereon adapted to engage the side wall of the switch case opposite the receiving member. The other resilient cantilevered member has a projection thereon which is adapted to urge the switch case toward the lugs on the projecting portions of the rails and on the receiving member.

DESCRIPTION OF THE PREFERRED EMBODIMENT

Figure 1:
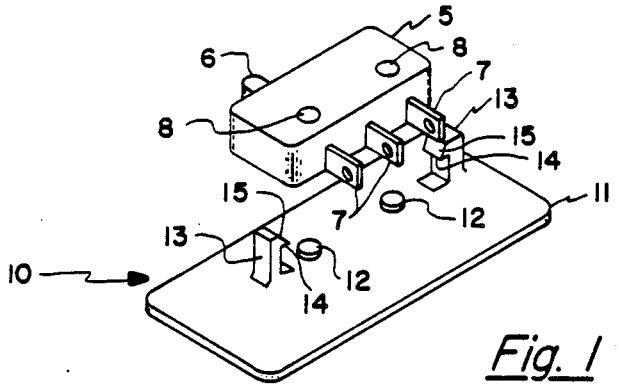
Fig. 1 PRIOR ART
FIG. 1 is a perspective view of one conventional miniature electrical switch and a switch mounting device of one conventional design for mounting the switch.
Figure 2:
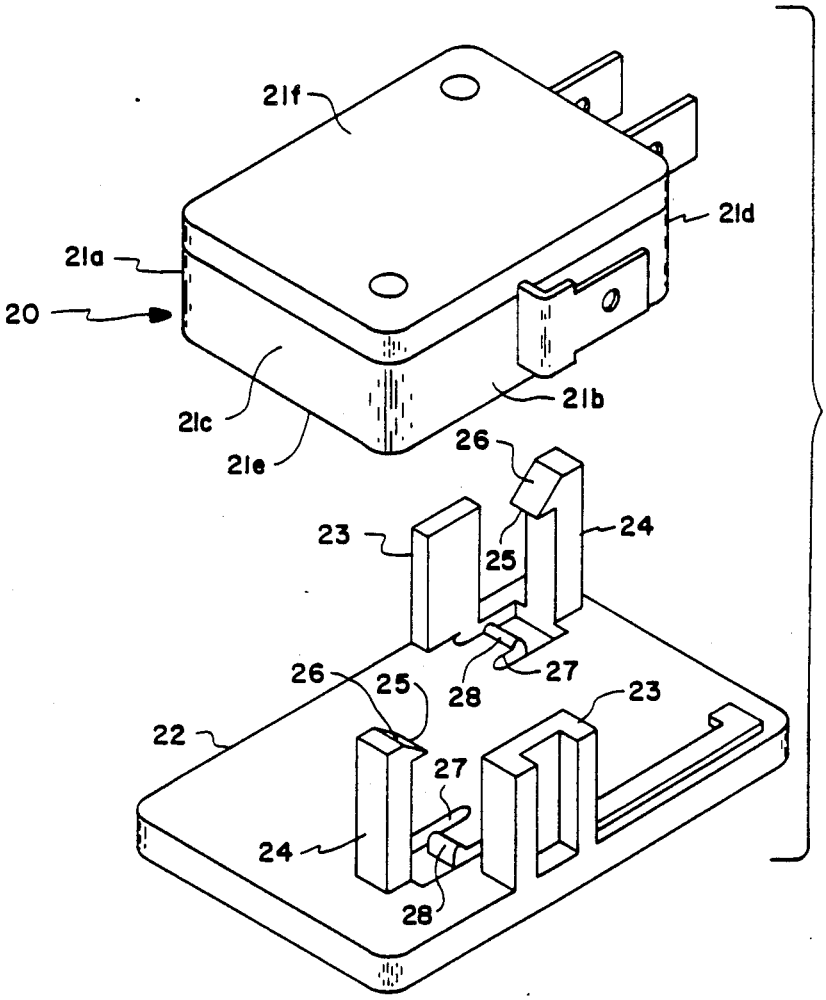
Fig. 2 PRIOR ART
FIG. 2 is a perspective view of a second conventional miniature electrical switch and a switch mounting device of a second design for mounting the switch.
Figure 3:
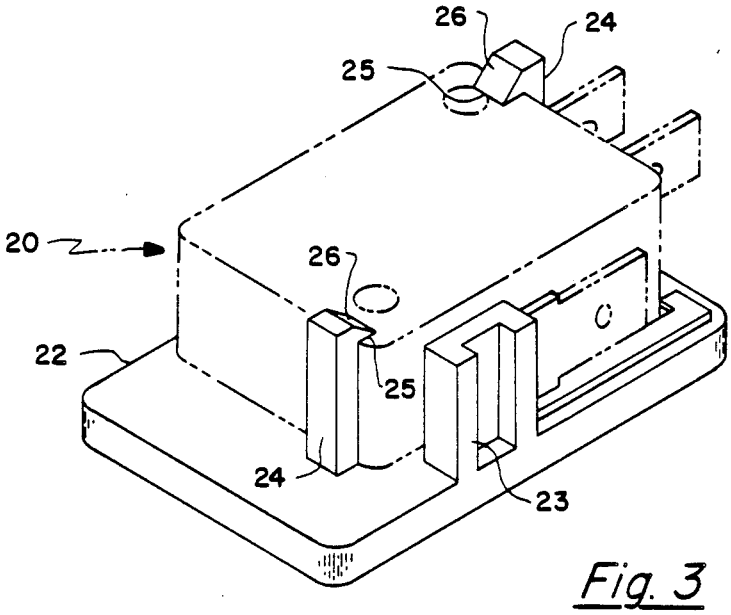
Fig. 3 PRIOR ART
FIG. 3 is a perspective view of the switch and mounting device of FIG. 2 with the switch in phantom lines mounted in the mounting device.
Figure 4:
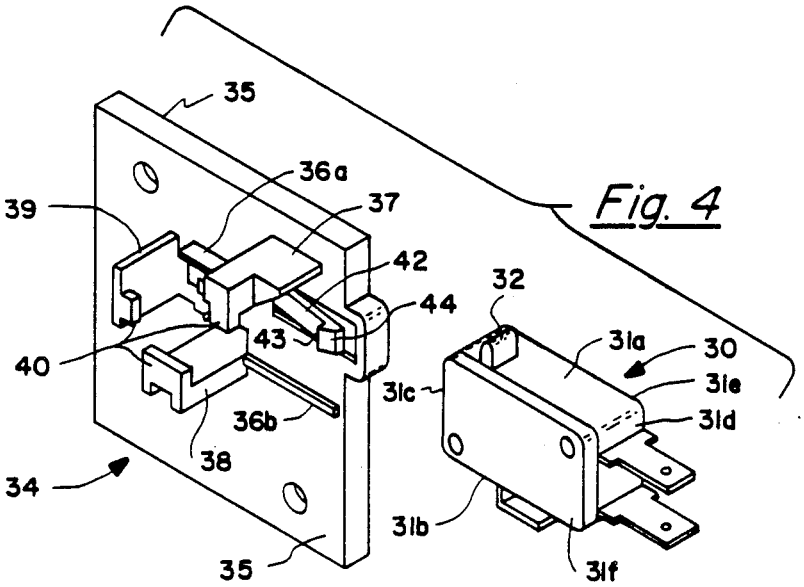
FIG. 4 is a perspective view of a miniature electrical switch similar to that shown in FIGS. 2 and 3 and a mounting device of the applicants' design for mounting such a switch.
Figure 5:
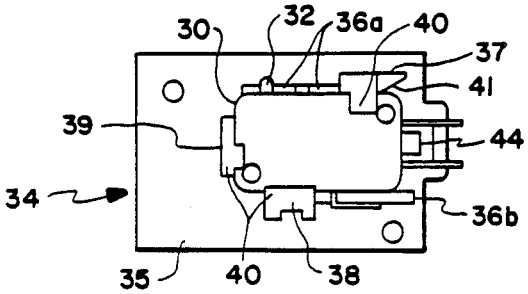
FIG. 5 is a plan view of the switch mounting device of FIG. 4 with the switch inserted therein.
Figure 6:
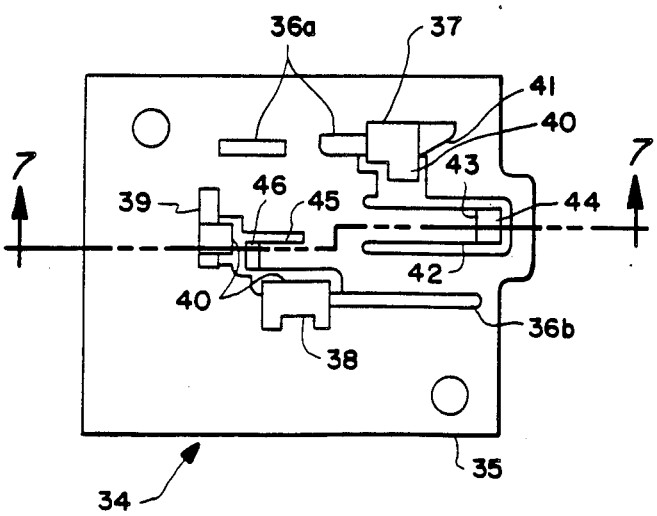
FIG. 6 is a plan view of the switch mounting device of FIGS. 4 and 5 without the switch mounted therein to expose certain details of the mounting device.
Figure 7:
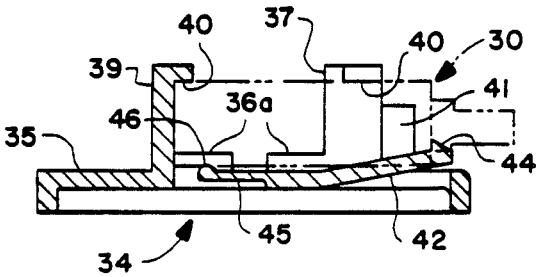
FIG. 7 is a sectional elevation view of the switch mounting device of FIGS. 4–6 taken along lines 7—7 in FIG. 6.

In order to facilitate an appreciation of the features and characteristics of the applicants' invention, two examples of prior art switch mounting devices will first be described. These devices are shown in FIGS. 1–3. With reference to FIG. 1, reference numeral 5 identifies a miniature electrical switch having a plunger 6 in one side wall thereof, a plurality of electrical terminals 7 in an opposite side wall thereof and a pair of mounting holes 8 extending therethrough from top to bottom.

Reference numeral 10 generally identifies a mounting device having a base 11 with a pair of locating projections 12 thereon adapted to extend into mounting holes 8 in the switch. A pair of resilient projections 13 are formed on the base at locations adjacent switch side walls transverse to the side walls through which plunger 6 and terminals 7 extend when the switch is positioned on locating lugs 12. The ends of projections 13 remote from base 11 are formed with lugs 14 adapted to engage the top surface of the switch when it is in place. The edges of lugs 14 facing away from base 11 are formed with inclined surfaces 15 to facilitate spreading of projections 13 as the switch is inserted between the projections. When the switch is properly in place, lugs 14 snap over the upper surface of the switch to hold it in place.

One of the disadvantages of this design is that switch removal and replacement is somewhat difficult because removal requires simultaneous outward deflection of both projections 13 and lifting of switch 5 from locating lugs 12. A further disadvantage is that very close tolerances are required of both the switch casing and the distance of lugs 14 from the upper surface of base 11 in order to achieve firm switch mounting. If the spacing between lugs 14 and the upper surface of base 11 is slightly less than the height of the side walls of switch 5, the lugs will not snap over the upper surface of the switch so as to secure it in place. Conversely, if the spacing between the lugs and the upper surface of the base is greater than the height of the switch side walls, the switch is not firmly held in place.

In FIG. 2, reference numeral 20 generally identifies a miniature electrical switch having a first side wall **21*a* with a plunger (not shown) therein, a second side wall 21*b* opposite side wall 21*a* and opposing side walls 21*c* and 21*d* transverse to side walls 21*a* and 21*b*. Switch 20 also has bottom and top walls with outer surfaces 21*e* and 21*f*** respectively.

As shown in FIGS. 2 and 3, the mounting device for switch 20 comprises a base 22 having a pair of projecting posts 23 thereon adapted to receive and position side walls **21*a* and 21*b* of switch 20 when it is in place on the mounting device. Base 22 also has a pair of resilient projections 24 thereon positioned adjacent switch side walls 21*c* and 21*d* when the switch is in place. Each of projections 24 has a lug 25 on the end thereof remote from base 22. The distance between the lugs and the upper surface of base 22 is approximately equal to the height of the switch side walls so that as the switch is inserted onto the base, lugs 25 snap over top surface 21*f* of the switch to secure it in place. The surfaces 26 of lugs 25 remote from base 22 are sloped to facilitate spreading of projections 24** as the switch is inserted onto the base, this feature being similar to the corresponding feature of the mounting device of FIG. 1.

Base 22 is formed with a pair of resilient cantilevered members 27, each having an upwardly extending projection 28 on the free end thereof. When switch 20 is in place, projections 28 bear against bottom surface 21*e* of the switch and urge it against lugs 25. This construction firmly holds the switch in place without requiring critical dimensional tolerances of the switch or the mounting device. However, this design is subject to the same difficulties in removing the switch from the mounting device as the design of FIG. 1.

Referring now to the applicants' invention as shown in FIGS. 4–7, reference numeral 30 generally identifies a miniature electrical switch similar to switch 20. Switch 30 has a first side wall 31*a* through which a plunger 32 extends, a side wall 31*b* opposite side wall 31*a* and opposing side walls 31*c* and 31*d* transverse to side walls 31*a* and 31*b*. Switch 30 also has lower and upper walls with outer surfaces 31*e* and 31*f* respectively separated by the height of the side walls.

In FIGS. 4–7, reference numeral 34 generally identifies a switch mounting device in accordance with the applicants' invention. Switch mounting device 34 comprises a base 35 having first and second rails 36*a* and 36*b* formed thereon.

Rail 36*a* is shown as comprising two aligned rail segments. Although a segmented rail is shown, a continuous rail would perform its required function equally as well. Also, for purposes of the present invention, the composition of the material from which device 34 is formed is not important, provided that it is characterized by suitable properties to achieve resilient members, etc., as described hereinafter.

Rails 36*a* and 36*b* are approximately parallel and are spaced apart a distance at least as great as the distance between switch side walls 31*a* and 31*b* to define a receiving channel for switch 30. One of the segments of rail 36*a* includes a projecting guide 37 which extends from base 35 a distance at least as great as the height of the switch side walls. Similarly, rail 36*b* includes a projecting guide 38 which extends from base 35 a distance at least as great as the height of the switch side walls.

Also extending from base 35 at one end of rails 36*a* and 36*b* is a receiving member 39. Guides 37 and 38 and receiving member 39 each have a lug 40 formed on the end thereof remote from base 35. Lugs 40 are spaced from the upper surface of base 35 a distance approximately equal to the height of the switch side walls. Accordingly, lugs 40 engage the upper surface 31*f* of the switch when it is in place in mounting device 34.

Projecting guide 37 is formed with a ramp surface 41 on its inner face which serves to depress plunger 32 as switch 30 is slid into place between rails 36*a* and 36*b*. Rails 36*a* and 36*b* and receiving member 39 define a receiving area for confining switch 30.

Base 35 is formed with a first resilient cantilevered member 42 having a free end extending away from receiving member 39, member 42 being inclined away from base 35 toward lugs 40. A lug 43 is formed on the free end of member 42, and is positioned to engage switch side wall 31*d* when switch 30 is in place in mounting device 34. The inclined configuration of member 42 serves both to cause lug 43 to snap over switch side wall 31*d* when the switch is in place and to urge the switch against lugs 40. Lug 43 is formed with a sloped outer face 44 to facilitate downward deflection of member 42 as the switch is inserted into mounting device 34.

Also formed in base 35 is a second resilient cantilevered member 45 extending toward and having a free end proximate receiving member 39. The free end of member 45 is formed with a projection 46 thereon adapted to bear against switch surface 31*e* and to urge the switch against lugs 40. Thus, resilient members 42 and 45, lug 43 and projection 46 cooperate together to firmly secure switch 30 in place.

A switch 30 is inserted onto the mounting device, member 42 is deflected downwardly as the switch rides over surface 44 on lug 43. As plunger 32 reaches ramp surface 41, the plunger is depressed. After the plunger passes projecting guide 37, it snaps back to its undepressed position where it is free for normal operation. When switch 30 is fully inserted into mounting device 34, lug 43 snaps into engagement with switch side wall 31*d* to secure the switch in place.

Switch 30 can be removed from mounting device 34 simply by depressing lug 44 to disengage it from switch side wall 31*d*, and pulling the switch along guides 36*a* and 36*b*. Once plunger 32 reaches projecting guide 37, it must be depressed to allow it to pass the guide. All of the operations required for insertion and removal are simple and convenient. Although the applicants' mounting device design provides for easy removal and replacement, it achieves firm mounting of the switch when it is in place.

A single embodiment of the applicants' invention has been shown and described for illustrative purposes. Other embodiments and features which do not depart from the applicants' teaching will be apparent to those of ordinary skill in the relevant arts. Accordingly, the applicant does not wish to be limited to the disclosed embodiment, but only by the terms of the following claims.

The embodiments of the invention in which an exclusive property or right is claimed are defined as follows:

1. A switch mounting device for a switch with a case having top and bottom walls, first and second opposing side walls and third and fourth opposing side walls transverse to the first and second side walls, and a plunger extending through the first side wall, the mounting device comprising:

a base;

first and second rails formed on said base at a predetermined spacing, said rails defining a channel adapted to receive a switch positioned with the bottom wall of the switch case proximate said base and the first and second side walls of the case adjacent said first and second rails respectively;

a receiving member formed on said base, said receiving member being located and configured for abutment with the third side wall of the switch case when the switch is positioned between said rails;

lugs formed on each of said rails and said receiving member and loated to engage the top wall of the switch case when the switch is positioned between said rails so as to hold the switch proximate said base;

a first resilient cantilevered member formed in said base and having a free end extending away from said receiving member and inclined away from said base so as to urge the switch toward said lugs, the free end of said first cantilevered member having a projection thereon adapted to engage the fourth side wall of the switch case; and a second resilient cantilevered member formed in said base and having a free end adjacent said receiving member, the free end of said second cantilevered member being adapted to urge the switch toward said lugs.

2. The switch mounting device of claim 1 wherein the lug on said first rail is formed on a portion of the rail which projects from said base a distance at least as great as the height of the first side wall of the switch case, the portion being configured with a ramp surface adapted to depress the switch plunger as the switch is inserted into the mounting device along said first and second rails.

3. A switch mounting device for a switch with a case having top and bottom walls, first and second opposing side walls and third and fourth opposing side walls transverse to the first and second side walls, and a plunger extending through the first side wall, the mounting device comprising:

a base;

first and second rails formed on said base, said first and second rails being substantially parallel and spaced apart a distance at least as great as the distance between the first and second side walls of the switch case;

a projecting portion of said first rail extending from said base a distance at least as great as the height of the first side wall of the switch case and having a lug thereon adapted to engage the top of the switch case, said projecting portion of said first rail further being formed with a ramp surface adapted to depress the switch plunger as the switch is inserted into the switch mounting device along said first and second rails;

a projecting portion of said second rail extending from said base a distance at least as great as the height of the second side wall of the switch case and being formed with a lug adapted to engage the top wall of the switch case;

a receiving member formed on said base at one end of said first and second rails, said receiving member projecting from said base a distance at least as great as the height of the third side wall of the switch case and having a lug formed thereon adapted to engage the top wall of the switch case;

a first resilient cantilevered member formed in said base and having a free end extending away from said receiving member and inclined away from said base, said first cantilevered member having a projection formed on the free end thereof adapted to engage the fourth side wall of the switch case; and a second cantilevered member formed in said base proximate said receiving member and being adapted to urge the switch case toward the lugs on the projecting portions of said first and second rails and said receiving member.

* * * * *